United States Patent [19]

Nash

[11] Patent Number: 4,628,653

[45] Date of Patent: Dec. 16, 1986

[54] INSULATED CONCRETE PANEL

[75] Inventor: Richard C. Nash, Savage, Minn.

[73] Assignee: Fabcon, Inc., Savage, Minn.

[21] Appl. No.: 576,544

[22] Filed: Feb. 3, 1984

Related U.S. Application Data

[63] Continuation of Ser. No. 281,999, Jul. 10, 1981, abandoned.

[51] Int. Cl.[4] ..... E04C 1/00

[52] U.S. Cl. ..... 52/309.12; 52/405; 52/542

[58] Field of Search ..... 52/309.12, 309.7, 309.9, 52/408, 409, 410, 541, 536, 806, 807, 808, 809, 404, 405, 542

[56] References Cited

U.S. PATENT DOCUMENTS

| | | | |
|---|---|---|---|
| 3,411,256 | 11/1968 | Best | 52/515 X |
| 3,466,825 | 9/1969 | Guddal | 52/309.12 X |
| 3,763,614 | 10/1973 | Hyde et al. | 52/309.9 |
| 3,812,635 | 5/1974 | Hala | 52/410 |
| 3,862,527 | 1/1975 | Peterson | 52/408 X |

FOREIGN PATENT DOCUMENTS

| | | | |
|---|---|---|---|
| 640458 | 11/1963 | Belgium | 52/309.9 |
| 4971 | of 1906 | United Kingdom | 52/565 |

*Primary Examiner*—Norman Morgenstern
*Assistant Examiner*—Janyce A. Bell
*Attorney, Agent, or Firm*—Vidas & Arrett

[57] ABSTRACT

An insulated concrete panel utilizing interlocking sheets of insulation material sandwiched between two layers of concrete. The insulation material sheets are interlocked utilizing a symmetrical partial dovetail locking structure permitting subsequent sheets of insulating material to be interlocked with previously emplaced sheets without disturbance.

12 Claims, 3 Drawing Figures

INSULATED CONCRETE PANEL

This is a continuation of application Ser. No. 281,999, filed July 10, 1981 now abandoned.

BACKGROUND OF THE INVENTION

The present invention relates in general to the manufacture of insulated concrete planks for use in walls and floors of building structures.

Reinforced precast, prestressed concrete planks or panels have been used for a number of years as wall and floor structures in buldings. Because of the increasing emphasis on producing well-insulated buildings, it became apparent some time ago that such planks were extremely poor in their insulation qualities. One approach to overcoming this defect of such panels was to cast panels in a "sandwich" configuration with a sheet of insulating material such as polyurethane or polystyrene between adjacent layers of concrete. Such a sandwich construction provided a noticeable improvement in the insulating qualities of the panel.

One of the problems which has been noted in sandwich concrete panels is the tendency of the top concrete layer to form stress cracks in the surface. It has been noted that such stress cracks most commonly form above the butt joint between adjacent pieces of insulating material. Such stress cracks have a highly undesirable cosmetic effect since the outer face layer of concrete is often exposed to view without any additional surface treatment being applied thereto.

SUMMARY OF THE INVENTION

The insulated concrete panel, according to the present invention utilizes insulating sheets having interfitting edges to form an interlocked insulating layer comprised of a plurality of interlocked insulating sheets.

The interlocked structure of the insulating panels is symmetrical in configuration so that a particular panel can be used for either interlocking function by merely rotating the panel 180°.

Insulating panels, according to the present invention, do not have a heat conducting gap between adjacent abutting sheets of insulating material. Avoidance of the discontinuities in insulating characteristics inherent in prior art sandwich panels results in a virtual elimination of the stress cracking of the surface layer of concrete and provides superior insulating characteristics of the insulated panels as a whole.

The improved process of manufacturing insulated concrete panels is not complicated by the use of the interlocking insulation sheets. The sheets can be applied to the cast bottom layer of concrete one at a time during the casting process. The particular structure of the interlock permits a subsequent sheet to be interlocked with an already positioned sheet without the necessity of moving the already positioned sheet. Additionally, the structure of the interlocks permits either of the interlocked sides of a sheet to be aligned with an already positioned sheet merely by rotating the subsequent sheet 180° about an axis perpendicular to its surface. In other words, the two lock structures are interchangeable merely by rotating the sheet.

OBJECTS OF THE INVENTION

It is, accordingly, an object of the invention to provide an insulated concrete panel having an insulating layer comprised of a plurality of interlocked insulating sheets without gaps therebetween.

It is a further object of the present invention to provide an insulating sheet for an insulated panel which can be readily interlocked with adjacent sheets to facilitate the manufacture of an insulated concrete panel. It is a still further object of the present invention to provide a method for manufacture of insulated sandwich panels having an insulating layer with substantially uniform insulating characteristics.

These and other objects and advantages of the present invention will become apparent to those skilled in the art from the detailed description of a preferred embodiment of the invention which follows and taken in conjunction with the accompanying drawings in which like parts are designated by the same reference numerals.

DETAILED DESCRIPTION OF THE PREFERRED EMBODIMENT

Figure 2:
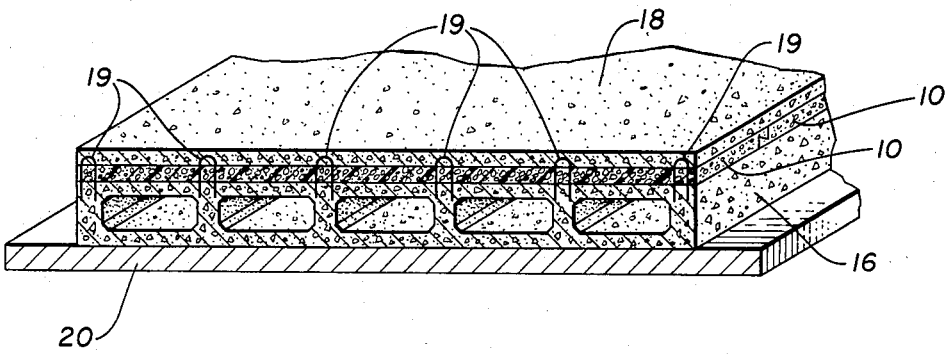
FIG. 2 is a perspective view of a hollow core concrete panel.
Figure 1:
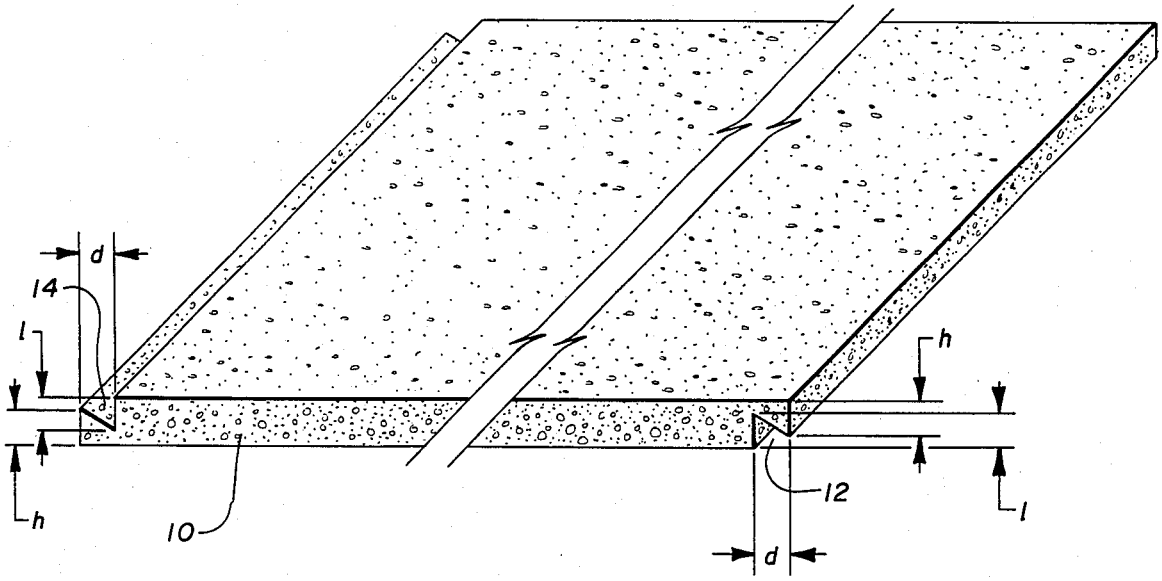
FIG. 1 is a fragmentary view of an insulating sheet according to the present invention showing the interfitting locking edges thereof.

FIG. 1 shows an insulating sheet 10 according to the present invention. For an insulated panel of 8-foot wide width, as shown, for example, in FIG. 2, the sheet 10 has a length substantially equal to the width of the concrete panel, about 8 feet in a preferred embodiment. The width of the insulating sheet 10 can be any convenient width in the neighborhood of three to five feet. The insulating sheet 10 has interlocking means 12 and 14 along two opposite edges along its length. The interlocking means 12 and 14 are used to interlock adjacent insulating sheets 10 to form an interlocked insulating layer between the lower concrete layer 16 and upper concrete layer 18, as shown in FIG. 2. Conventional staple means 19 are used to form a bond joining the bottom, top and insulation layers into a single structure as is known in the prior art.

FIG. 1 illustrates the preferred embodiment of the interlocking means 12 and 14. Seen in side view, each individual interlocking structure resembles one-half of a dovetail mortise and tenon locking structure divided on a plane bisecting the dovetail interlock and perpendicular thereto. The interlocking edges 12 and 14 have 180° symmetry relative to each other. The sheets are rotated by 180° relative to each other to permit the mating of one edge of an insulating sheet 10 with a particular prepositioned sheet, no matter which edge is exposed, merely by turning the interlocking sheet over. The sheet can also be more readily manufactured if the same locking structure is formed on both edges. Thus, the angle of the fan-shaped tenon portion is identical on both interlocking edges 12 and 14, as are the depths of the various corresponding cuts L, H and D, as indicated in FIG. 1.

Figure 3:
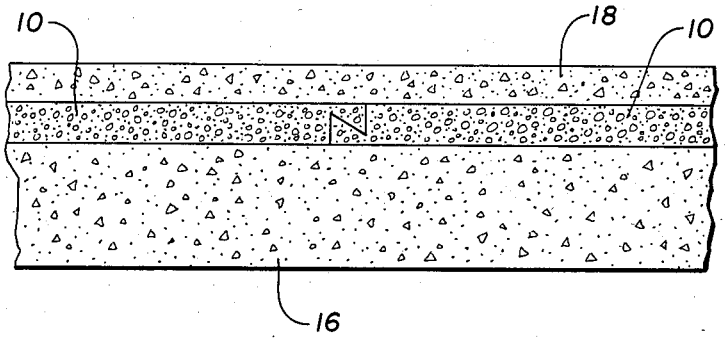
FIG. 3 is a fragmentary side view of the concrete panel shown in FIG. 2 illustrating the interlocking of insulating sheets in accordance with the present invention.

The use of the interlocking structure, as shown in FIGS. 1 through 3, accomplishes definite improvements over prior art insulated panels. Where the insulated panel is formed by abutting sheets of insulating material in edge-to-edge relationship, there is a conductive path remaining between adjacent sheets which permits non-uniform heat flow between the lower concrete layer 16 and the upper layer 18. This is particularly troublesome when accelerated curing methods are used to cure the concrete panel. When such accelerated curing is utilized, the lower concrete layer 16 is heated by means of a heated pallet 20 upon which the panel is cast or by other similar means.

The uneven transmission of heat during curing often resulted in the formation of stress cracks in prior art insulated panels in the upper concrete surface 18 aligned with the junction between adjacent insulating sheets, Such joints between insulating sheets also resulted in additional insulation loss through the panel.

Although other edge mating approaches could be envisioned to avoid the non-uniform insulating characteristics caused by butting two sheets of insulating material together along their unmodified edges, those other structures have been considered and found not to provide all of the advantages provided by the structure in accordance with the present invention. For example, if the edges of the insulating material are merely mitered, there is no interlocking between adjacent sheets, and the advantages of an interlocked insulating layer are lost.

If the edge of an insulating sheet were modified into half of a conventional mortise and tenon joint with all right angles and having a pair of interfitting edges, some improvement might be noted, but the resulting structure would not be interlocking. It would also not have as long a thermal path as the lock according to my invention because the partial dovetail structure, according to my invention, has a heat transmission path along the joint betwen the two sheets which, because it doubles back on itself, is longer than the path on a comparable partial mortise and tenon lock.

FIG. 2 shows a typical bond between two insulating sheets 10 in a typical sandwich panel. It can be seen that the path between the adjacent sheets in longer than the path that would be formed between abutting sheets with straight sides.

What is claimed is:

1. In a reinforced, precast, prestressed insulated concrete panel formed from a bottom uncured concrete layer, an upper uncured concrete layer and an insulating layer between said concrete layers comprised of a plurality of insulating sheets arrayed intermediate said concrete layers in an abutting relationship to one another, and staple means passing through said insulating sheets and partially into said bottom and upper concrete layers before heat accelerated curing and forming a bond therewith to lock said layers in fixed relationship after curing such that said panels are self-supporting, and improvement comprising:

insulating sheets dimensioned to span the width of said concrete panel and having a thickness sufficient to interpose a substantial barrier to the flow of heat between the concrete layers of said panel and said insulating sheets configured to have interlocking edges along oppposite edges thereof thereby forming an interlocked abutting insulating layer of adjacent sheet which prevents longitudinal separation and which substantially limit flow of heat through said edges by increasing the length of the heat transmission path and thereby reduce the possibility of stress cracks in the upper concrete layer aligned above said sheet edges caused by uneven transmission of heat during heat accelerated curing.

2. The insulating sheet of claim 1 wherein said interlocking edges comprise a notch cut along one edge of each insulating sheet and a complimentary interfitting notch cut along the other edge of each insulating sheet whereby a plurality of said sheets can be interlocked and positioned on said bottom concrete layer before the casting of said upper concrete layer.

3. The sheet of claim 1 wherein said locking edges comprises a first locking structure along one edge thereof and a second locking structure along the other edge thereof.

4. The invention of claim 3 wherein said first locking structure has an edge cross-section corresponding to the upper half of a fan-shaped mortise; and said second locking structure has an edge cross-section corresponding to the upper half of a tenon constructed and arranged for insertion into the mortise of said first locking structure.

5. The invention of claim 3 wherein said first locking structure and said second locking structure have 180° symmetry.

6. A method for manufacturing reinforced precast, prestressed insulated concrete panels comprising the steps of:

(a) casting a bottom layer of concrete;

(b) forming an insulating layer by covering the bottom layer of concrete before curing with a plurality of insulating sheets, each of said sheets configured on abutting edges to provide a locking joint edge when joined to an adjacent sheet for forming an interlocking abutting insulation layer which substantially limits flow of heat through said edges by increasing the length of the heat transmission path and preventing longitudinal separation of said sheets such that stress cracking in the upper concrete layer above the interlocked sheet edges is reduced due to more even transmission of heat during curing;

(c) inserting bond forming means through said insulating layer into said bottom uncured layer while leaving a portion of said means projecting above said sheets; and (d) pouring a top layer of concrete over the insulating layer and around said bond forming means that projects above said sheets and heat accelerated curing said concrete layers such that said bottom layer, insulating layer and upper layer are held together by said bond forming means such that said completed insulated concrete panel is self-supporting.

7. An insulated reinforced precast, prestressed concrete panel for use as wall and floor structures in buildings comprising:

(a) a bottom layer of cast concrete;

(b) an insulating layer comprised of a plurality of insulating sheets arrayed in an abutting relationship to each other on top of and covering said bottom layer of concrete, each of said sheets having interlocking edges along opposite edges thereof thereby forming an interlocked abutting insulating layer of adjacent sheets which substantially limit flow of heat through said edges by increasing the length of the heat transmissive path and prevents longitudinal separation.

(c) an upper layer of concrete cast onto said insulating layer; and (d) staple means passing through said insulating sheets and partially into said bottom and upper concrete layers prior to curing, said staple means forming a bond between said layers after heat accelerated curing, such that said panel may be moved without causing separation of the layers.

8. The insulated concrete panel of claim 7 wherein said interlocking edges comprise a first locking structure along one edge thereof and a second locking structure along the other edge thereof.

9. The structure of claim 8 wherein said first locking structure has an edge cross-section corresponding to the upper half of a fan-shaped mortise and said second locking structure has an edge cross-section corresponding to the upper half of a tenon constructed and arranged for insertion into the mortise of said first locking structure.

10. The structure of claim 8 wherein said first locking structure and said second locking structure have 180° symmetry.

11. The insulated concrete panel of claim 7 wherein said interlocking edges comprise a notch cut along one edge of each insulating sheet and a complimentary interfitting notch cut along the other edge of each insulating sheet whereby a plurality of said sheets can be interlocked and positioned on said bottom concrete layer before the casting of said upper concrete layer.

12. A method for reducing stress cracking in the manufacturing of reinforced precast, prestressed, insulated concrete panels for use as wall and floor structures in buildings comprising:

(a) casting a bottom layer of concrete;

(b) forming an insulating layer by covering the bottom layer of concrete before curing with a plurality of insulating sheets, each of said sheets; configured on abutting edges to provide a locking joint edge preventing longitudinal separation thereof when joined to an adjacent sheet and for increasing the heat transmission path length to reduce the possibility of stress cracks in concrete above said sheet edges caused by uneven transmission of heat during accelerated curing;

(c) interlocking adjacent insulating sheets together along adjacent edges so as to form an interlocked insulating layer over said bottom layer of concrete;

(d) inserting bond forming means through said insulating layer into said bottom uncured layer such that at least a portion of said bond forming means extends above the surface of said insulating layer;

(e) pouring a top layer of concrete over the insulating layer and around said bond forming means; and (f) heat accelerated curing said concrete layers such that said bond means are firmly secured to both bottom and top layers of concrete so as to allow said cured insulated concrete panel to be moved without separating into separate sections due to the support provided by said bond means.

* * * * *